US008988294B2

(12) United States Patent
Voss et al.

(10) Patent No.: US 8,988,294 B2
(45) Date of Patent: Mar. 24, 2015

(54) ANTENNA WITH INTEGRATED CONDENSATION CONTROL SYSTEM

(71) Applicant: ViaSat, Inc., Carlsbad, CA (US)

(72) Inventors: John Daniel Voss, Cumming, GA (US); James W. Maxwell, Alpharetta, GA (US); Jeremy Deryl Standridge, Commerce, GA (US)

(73) Assignee: ViaSat, Inc., Carlsbad, CA (US)

( * ) Notice: Subject to any disclaimer, the term of this patent is extended or adjusted under 35 U.S.C. 154(b) by 330 days.

(21) Appl. No.: 13/707,307

(22) Filed: Dec. 6, 2012

(65) Prior Publication Data

US 2013/0141288 A1 Jun. 6, 2013

Related U.S. Application Data

(60) Provisional application No. 61/567,586, filed on Dec. 6, 2011.

(51) Int. Cl.

| | |
|---|---|
| ***H01Q 1/28*** | (2006.01) |
| ***H01P 5/12*** | (2006.01) |
| ***H01P 11/00*** | (2006.01) |
| ***H01Q 1/02*** | (2006.01) |
| ***H01Q 13/02*** | (2006.01) |
| ***H01Q 21/00*** | (2006.01) |

(52) U.S. Cl.

CPC ..... *H01P 5/12* (2013.01); *H01P 11/001* (2013.01); *Y10T 29/49016* (2015.01); *Y10T 29/49002* (2015.01); *H01Q 1/02* (2013.01); *H01P 11/00* (2013.01); *H01Q 13/0233* (2013.01); *H01Q 21/0037* (2013.01)

USPC ..... 343/705; 343/776

(58) Field of Classification Search

CPC . H01Q 1/02; H01Q 21/0037; H01Q 13/0233; H01P 11/00; H01P 11/001; H01P 5/12

USPC ..... 343/705, 772, 776, 786

See application file for complete search history.

(56) References Cited

U.S. PATENT DOCUMENTS

| | | | |
|---|---|---|---|
| 4,743,915 | A | 5/1988 | Rammos et al. |
| 5,243,357 | A | 9/1993 | Koike et al. |

(Continued)

FOREIGN PATENT DOCUMENTS

| | | | |
|---|---|---|---|
| WO | 02/09227 | A1 | 1/2002 |
| WO | 2006/061865 | A1 | 6/2006 |
| WO | 2008/069369 | A1 | 6/2008 |

OTHER PUBLICATIONS

Dittloff et al., Computer Aided Design of Optimum E- or H-Plane N-Furcated Waveguide Power Dividers, 17th European Microwave Conference, Sep. 7, 1987 to Sep. 11, 1987, pp. 181-186.

(Continued)

*Primary Examiner* — Hoanganh Le
(74) *Attorney, Agent, or Firm* — Viasat, Inc.

(57) ABSTRACT

In an example embodiment, an airborne radio frequency (RF) antenna device can comprise: a radiating portion; a waveguide portion connected to the radiating portion; a desiccant airflow channel; and an internal air volume located within the RF antenna device and associated with the desiccant airflow channel. The desiccant airflow channel can be integral with the RF antenna device. The internal air volume can be vented to the environment outside of the RF antenna device through the desiccant airflow channel.

19 Claims, 12 Drawing Sheets

(56) References Cited

U.S. PATENT DOCUMENTS

| | | | | |
|---|---|---|---|---|
| 5,291,650 | A | 3/1994 | Carvalho et al. | |
| 5,568,160 | A | 10/1996 | Collins | |
| 6,034,647 | A | 3/2000 | Paul et al. | |
| 6,201,508 | B1 | 3/2001 | Metzen et al. | |
| 6,411,174 | B1 | 6/2002 | Crouch et al. | |
| 6,563,398 | B1 | 5/2003 | Wu | |
| 7,564,421 | B1 * | 7/2009 | Edwards et al. | 343/776 |
| 7,927,402 | B1 | 4/2011 | Grzeslak et al. | |
| 8,558,746 | B2 * | 10/2013 | Thomson et al. | 343/776 |
| 2004/0178863 | A1 | 9/2004 | Chan et al. | |
| 2006/0226931 | A1 | 10/2006 | Tavassoli Hozouri | |
| 2007/0182507 | A1 | 8/2007 | Chang et al. | |
| 2011/0061539 | A1 | 3/2011 | Lam et al. | |
| 2011/0156838 | A1 | 6/2011 | Huang et al. | |
| 2011/0267250 | A1 | 11/2011 | Seifried et al. | |
| 2012/0218160 | A1 | 8/2012 | Montgomery et al. | |
| 2013/0141186 | A1 | 6/2013 | Nguyen et al. | |
| 2013/0141300 | A1 | 6/2013 | Runyon et al. | |
| 2013/0154764 | A1 | 6/2013 | Runyon et al. | |

OTHER PUBLICATIONS

Goldfarb, A Recombinant, In-Phase Power Divider, IEEE Transactions on Microwave Theory and Techniques, vol. 39, No. 8, Aug. 1991, pp. 1438-1440.

Rebollar et al., Design of a Compact KA-Band Three-Way Power Divider, IEEE, 1994, 0-7803-2009-3/94, pp. 1074-1077.

Sehm et al., A Large Planar Antenna Consisting of an Array of Waveguide Fed Horns, 26th EuMC, Sep. 9, 1996 to Sep. 12, 1996, Prague, Czech Republic, pp. 610-613.

Christopher et al., Design Aspects of Compact High Power Multiport Unequal Power Dividers, IEEE, 1996, 0-7803-3232-6/96, pp. 63-67.

Dudko et al., A Wide Band Matching of H-Plane Tee, MMET '96 Proceedings, Lviv, Ukraine, Vlth Int'l. Conf. on Mathematical Methods in Electromagnetic Theory, 1996, pp. 309-312.

Joubert et al., Design of Unequal H-Plane Waveguide Power Dividers for Array Applications, IEEE, 1996, 0-7803-3216-4/96, pp. 1639-1639.

Wollack, On the Compensation of E-Plane Bifrucations in Rectangular Waveguide, NRAO, Charlottesville, VA, Oct. 20, 1997.

Gardner et al., Mode Matching Design of Three-Way Waveguide Power Dividers, The Institute of Electrical Engineers, 1997, London, UK, 4 pgs.

Sehm et al., A Large Planar 39-Ghz Antenna Array of Waveguide-Fed Horns, IEEE Transactions on Antennas and Propagation, vol. 46, No. 8, Aug. 1998, pp. 1189-1193.

Soroka et al., Simulation of Multichannel Waveguide Power Dividers, MSMW '98 Symposium Proceedings, Kharkov, Ukraine, Sep. 15, 1998 to Sep. 17, 1998, pp. 634-635.

Sehm et al., A 38 Ghz Horn Antenna Array, 28th European Microwave Conference Amsterdam 1998, pp. 184-189.

Hersey et al., Self Regenerating Desiccant for Water Management in External Aircraft Electronics, IEEE, Aerospace Conference, Mar. 6, 1999 to Mar. 13, 1999, pp. 183-191.

Sehm et al., A High-Gain 58-Ghz Box-Horn Array Antenna With Suppressed Grating Lobes, IEEE Transactions on Antennas and Propagation, vol. 47, No. 7, Jul. 1999, pp. 1125-1130.

Sehm et al., A 64-Element Array Antenna for 58 Ghz, IEEE, 1999, 0-7803-5639-X/99, pp. 2744-2747.

Kerr, Alma Memo 381—Elements for E-Plane Split-Block Waveguide Circuits, http://www.mma.nrao.edu/memos/, Jul. 5, 2001.

Bozzi et al., A Compact, Wideband, Phase-Equalized Waveguide Divider/Combiner for Power Amplification, 33rd European Microwave Conference, Munich, 2003, pp. 155-158.

Yang et al., Synthesis of a Compound T-Junction for a Two-Way Splitter With Arbitrary Power Ratio, IEEE, 2005, 0-7803-8846-1/05, pp. 985-988.

Panda et al., Multiple Cavity Modeling of a Feed Network for Two Dimensional Phased Array Application, Progress in Electromagnetics Research Letters, vol. 2, 2008, pp. 135-140.

Mestezky et al., Unequal, Equi-Phase, 1:N Power Divider Based on a Sectoral Waveguide, Int'l. Journal of Microwave and Optical Technology, vol. 4, No. 3, May 2009, pp. 170-174.

Kim et al., Design of High Power Split Waveguide Array in W-Band, IEEE, 2009, 978-1-4244-5417-4/09, 2 pgs.

Chen et al., An Ultra Wide Band Power Divider/Combiner Based on Y-Structure Waveguide, IEEE, ICMMT 2010 Proceedings, 2010, 978-1-4244-5708-3/10, pp. 853-855.

* cited by examiner

ANTENNA WITH INTEGRATED CONDENSATION CONTROL SYSTEM

CROSS-REFERENCE TO RELATED APPLICATIONS

This application claims priority to U.S. Provisional Application No. 61/567,586, entitled "Mobile Antenna," which was filed on Dec. 6, 2011, the contents of which are hereby incorporated by reference for any purpose in their entirety,

FIELD OF INVENTION

The present disclosure relates generally to condensation control systems in airborne radio frequency (RIF) antenna devices, and specifically to passive condensation control systems including a desiccant airflow Channel integral with the RF device and functionally located between an air volume internal to the RF device and ambient air,

BACKGROUND

Feed horn type RF antenna devices typically have internal air volumes associated with the feed horn. For example, an air cavity typically exists within the interior of a feed horn. This interior space can be typically connected to a waveguide cavity, The feed horn can further be covered with an aperture closeout and otherwise sealed to keep moisture out of this interior space, If the pressure inside this interior air volume increases sufficiently, however, it is possible that the aperture close-out or other seals could rupture or be degraded to the point that moisture can enter the RF device, As discussed herein, moisture within the internal air volume of feed horn type RF antenna devices can significantly degrade the performance of the RF device. To illustrate this point, FIG. 9 illustrates the severe impact of one drop of water placed in each of 8 ports of an 8:1 RF combiner. As can be seen, there can be relatively little difference between the performance of a dry waveguide and a waveguide with water at the flange interface. However, the performance can be severely degraded if water is located near the power dividers where RF current densities can be the highest. This can be particularly true in Ku and Ka band frequency RF devices, In smaller, single feed horn RF antenna devices, it may be possible to minimize the total internal air volume such that sealing the device may work. However, sealing an antenna device can he less of an option in larger systems and systems that operate in changing environments.

In particular, an array-type airborne RF antenna would likely burst the seals or aperture close-out if built as a sealed internal air volume. Sealed array-type airborne RF antennas can generate pressure differentials between the internal air volume and ambient air, due to the interior air volume and altitude or temperature changes. Therefore, typically an array type airborne RF antenna may be vented to the ambient air. Such venting facilitates pressure equalization between the internal air volume and ambient air, Unfortunately, when built as a vented air volume, moisture can enter the interior air volume, Therefore, many complex solutions have been used to prevent condensation and/or reduce moisture in the air in the internal air volume of RF antennas of this type. These complex solutions are expensive, unreliable, heavy and/or large, in-efficient, and in general undesirable.

A new device, system and method for moisture and condensation control is now described.

SUMMARY

In an example embodiment, an airborne radio frequency (RF) antenna device can comprise: a radiating portion; a waveguide portion connected to the radiating portion; a desiccant airflow channel; and an internal air volume located within the RF antenna device and associated with the desiccant airflow channel. The desiccant airflow channel can be integral with the RF antenna device. The internal air volume can be vented to the environment outside of the RF antenna device through the desiccant airflow channel.

An airborne mobile radio frequency (RF) antenna device can comprise: an aperture grid plate; and an aperture horn plate attached to the aperture grid plate. The aperture horn plate can further comprise a passive integrated condensation control system comprising a desiccant airflow channel. The integrated condensation control system can be integral with the aperture horn plate. The antenna device can further comprise: azimuth combiners attached to the aperture horn plate, wherein the azimuth combiners can comprise first interconnected waveguides; and elevation combiners attached to the azimuth combiners. The elevation combiners can comprise second interconnected waveguides that can be configured to interconnect the first interconnected waveguides of a plurality of said azimuth combiners. The antenna device can further comprise: an internal air volume that can comprise the space inside a plurality of horns of the aperture horn plate, as well as the space within the first and second interconnected waveguides that can be connected to the plurality of horns, and the space within the aperture grid plate that extends from the plurality of horns.

A method of passive condensation control in an airborne RF antenna device having an internal air volume vented to atmosphere can comprise: flying the airborne RF antenna device to a high altitude: passing air between the internal air volume and the atmosphere via a passive integrated desiccant air flow channel that can be integrated into the RF antenna; and flying the airborne RF antenna device to a low altitude and protecting the internal air volume by absorbing moisture from air passing passively into the internal air volume from the external environment, The passive integrated desiccant air flow channel can comprise a cold regenerative type desiccant.

BRIEF DESCRIPTION OF THE DRAWING FIGURES

Additional aspects of the present invention will become evident upon reviewing the non-limiting embodiments described in the specification and the claims taken in conjunction with the accompanying figures, wherein like numerals designate like elements, and:

DETAILED DESCRIPTION

Figure 1:
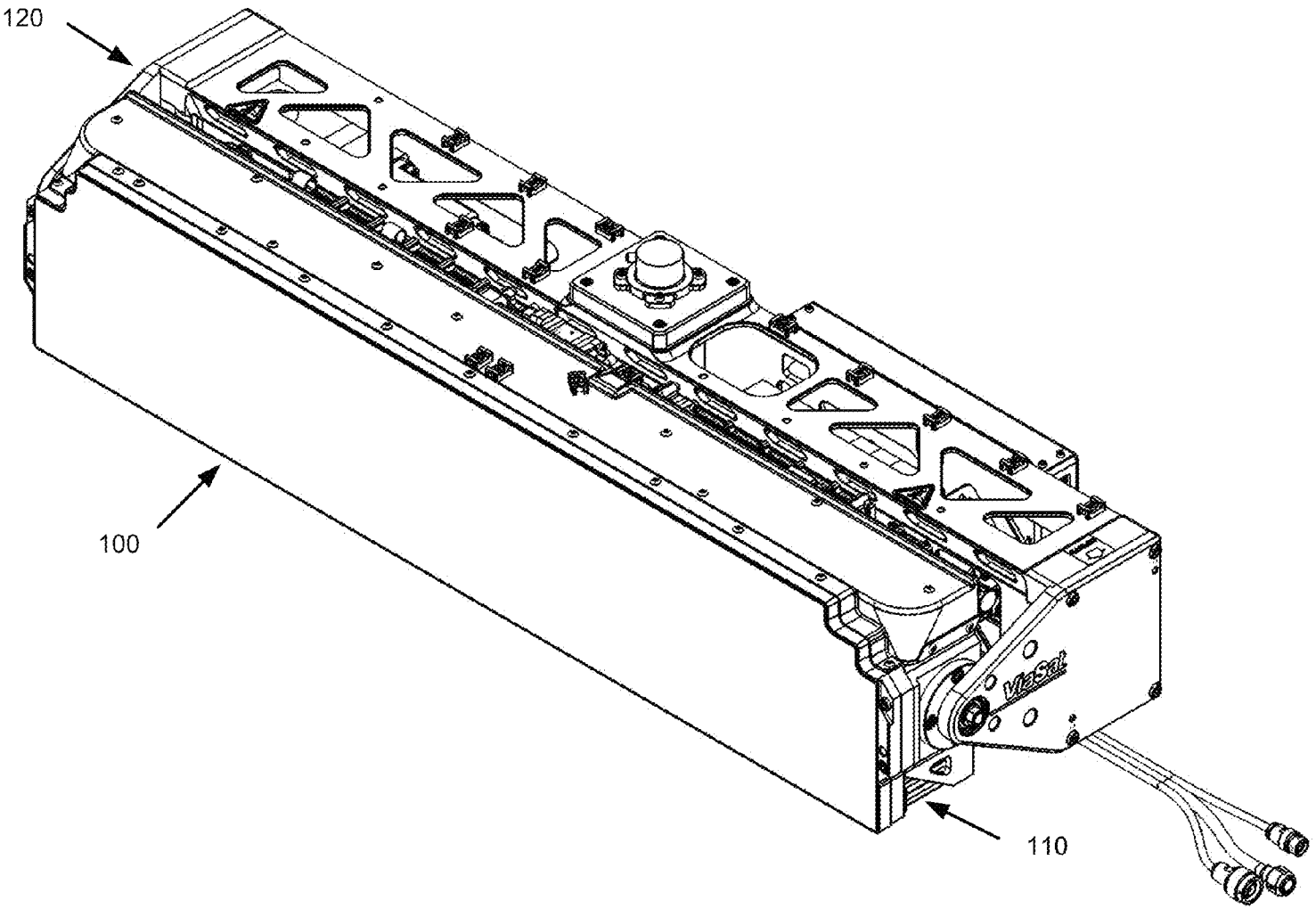
FIG. 1 is a perspective view of an example RF antenna aperture and positioner.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention, Many complex solutions have been used to prevent condensation and/or reduce moisture in the air in the internal air volume of RF antennas. For example, some approaches to condensation control include the addition of moisture/condensation control hardware onto existing hardware. One solution involves supplying a dry nitrogen purge to the interior air volume. Another solution employs condensation control tubes that cool the tubes to control where the moisture condenses, Additional control hardware can result in a large increase in hardware mass, increase in hardware footprint volume, increased part count and increased cost of manufacturing. Other solutions are disadvantageous because the location of venting ports or the venting port geometries make design difficult or cause degradation in the performance of the RF antenna. Some solutions connecting external desiccant systems require discreet parts, tubing, and fittings. These provide greater opportunity for breakdowns. Other solutions require power to run pumps, valves, or heaters. In addition to the added complexity, and the power consumption, these solutions can lead to inadvertent problems, For example, if the RF antenna is taken out of service for a few days, not only is it likely that the antenna will be powered off, but the condensation control system may become un-powered, too. Thus, the RF antenna may be unprotected from moisture condensation during that time period, New solutions are presented herein.

In accordance with various aspects, an airborne mobile RF antenna device can comprise an internal air volume, located within the RF antenna device, and a desiccant airflow channel. The internal air volume can be vented to the environment outside of the RF antenna through the desiccant airflow channel, Thus, the internal air volume can be non-hermetically sealed. In an example embodiment, the desiccant airflow channel can be integral with the RF antenna device. In various embodiments, the desiccant airflow channel can be integrated into an aperture horn plate. Thus, an airborne mobile RF antenna device can be configured with a passive integrated condensation control system.

With reference now to FIG. 1, in an example embodiment, an RF antenna 100 can comprise an antenna aperture 110 and a positioner 120. In an example embodiment, antenna aperture 110 can comprise an array of antenna horn elements connected via a combiner network. Positioner 120 can be a single or multi-axis mechanical antenna pointing system. Positioner 120 can be configured to point antenna aperture 110 at a satellite. In particular, positioner 120 can be configured to point antenna aperture 110 at a satellite as the RF antenna and/or satellite move relative to one another. For example, RF antenna system 100 can be located on an airplane. Antenna aperture 110 can be configured to send and receive RF signals between the satellite and RF antenna system 100. In this manner, RF antenna system 100 can be configured to facilitate providing communication, Internet connectivity, and the like to passengers on a commercial airline. Moreover, in one example embodiment, RF antenna system 100 can provide RF signal communication to a satellite from an airborne or otherwise mobile platform, be it commercial, personal, or military.

Figure 2:
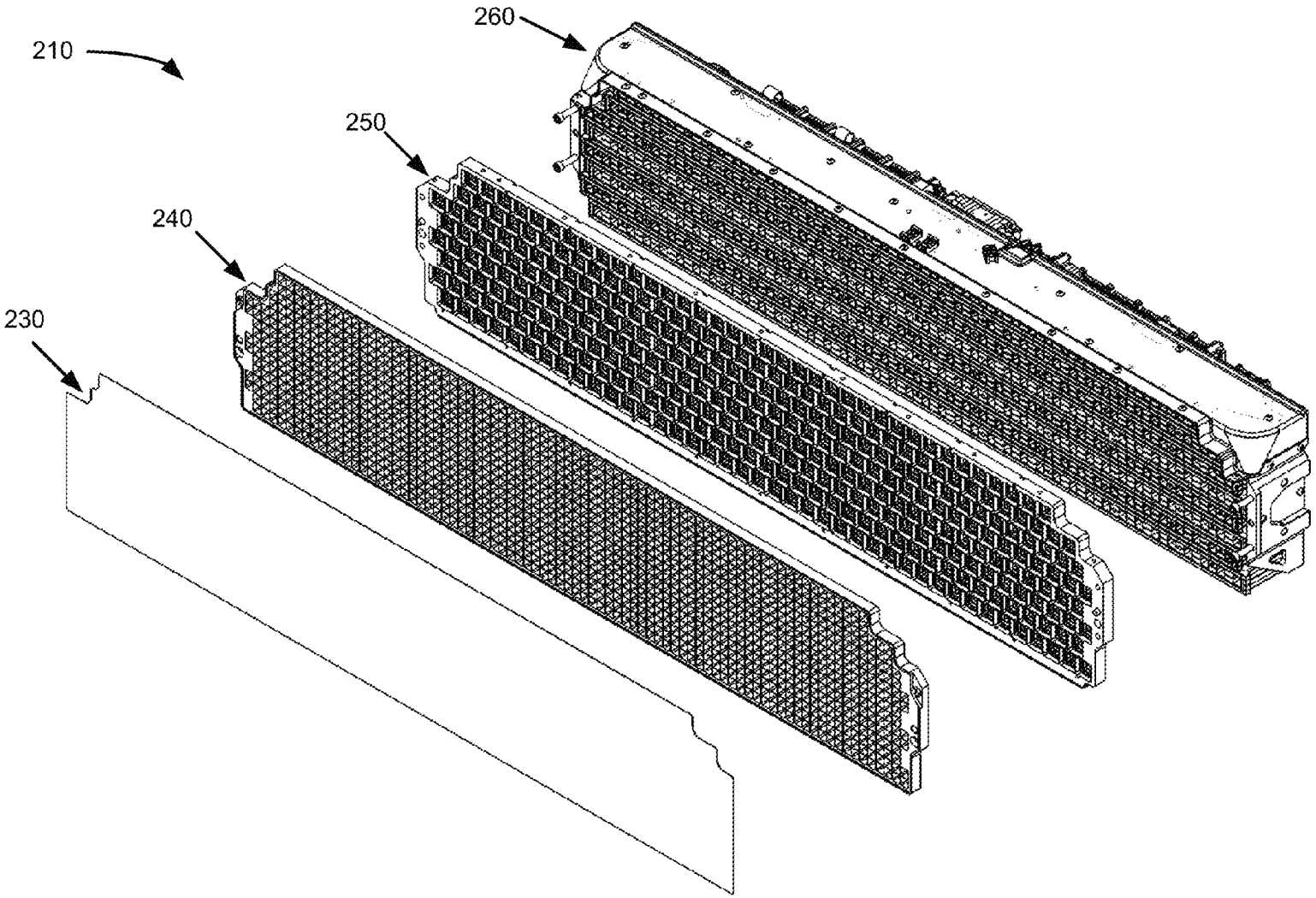
FIG. 2 is an exploded perspective view of an example RF antenna aperture, illustrating various example components of the example RF antenna aperture.

Antenna aperture 110 can comprise an aperture horn plate, aperture grid plate, aperture close out, azimuth combiners and elevation combiners. With reference now to FIG. 2, antenna aperture 210 can comprise an aperture close out 230, aperture grid plate 240, aperture horn plate 250, and azimuth and elevation combiners 260.

Aperture horn plate 250 can comprise an array of feed horns in a plate like structure. Aperture horn plate 250 can be attached proximate to aperture grid plate 240 on a first "aperture side" of aperture horn plate 250. Aperture grid plate 240 can comprise a grid or array of box like walls. Aperture grid plate 240 can be configured to separate signals received at the aperture of antenna 210 and channel those signals to each individual feed horn of aperture horn plate 250.

Azimuth and elevation combiners 260 can be attached proximate to aperture horn plate 250 and on the side opposite of aperture grid plate 240. Azimuth and elevation combiners 260 can comprise a network of waveguides. Stated another way, azimuth and elevation combiners 260 can comprise more than one interconnected waveguides. In one example embodiment, azimuth and elevation combiners 260 can connect a waveguide to each feed horn of aperture horn plate 250. The waveguides of azimuth and elevation combiners 260 can be configured to combine the signals from each connected waveguide into a single signal input/output. Thus, azimuth and elevation combiners 260 can he configured to combine the RF signal from a plurality of feed horns of the aperture horn plate into a single RF signal.

Aperture close-out 230 can be connected to aperture grid plate 240. Aperture close-out 230 can be connected to aperture grid plate 240 on the side of aperture grid plate 240 that is opposite aperture horn plate 250. In one example embodiment, aperture close-out 230 can be a RF window. For example, Neleo 9200. This material can possess low dielectric and loss tangent properties that can minimize RF performance degradation as RF signals propagate through the window. Other suitable materials with similar RF properties such as polytetrafluoroethylene (PTFE) could also be used. Moreover, aperture close out 230 can be any material suitably configured to seal off the aperture grid plate and protect the interior air cavity of the aperture grid plate and horn plate from moisture or debris, while still allowing the RF signals to pass through.

Thus, antenna aperture 210 can comprise an internal air volume. The internal air volume, in one example, can be defined as the cavity that is bounded on one end by aperture close out 230 and formed within (1) the interstitial spaces formed by aperture grid plate 240, (2) within the interior cavities of the various feed horns, and/or (3) within the various waveguides of the waveguide combiners connected to the feed horns of aperture horn plate 250. Stated another way, the internal air volume can comprise the space inside at least one horn, and generally a plurality of horns, of the aperture horn plate. The internal air volume can comprise the space extending from the plurality of horns through the grid plate. The internal air volume can comprise the space within the plurality of interconnected waveguides that are connected to the plurality of feed horns. The internal air volume can comprise at least one of these spaces.

Moreover, the internal air volume can comprise all the air volume internal to RF antenna aperture 210. In other embodiments, the internal air volume can be defined as a sub-portion of all the air volume internal to antenna aperture 210. Furthermore, the internal air volume can further include air volumes extending in additional waveguide(s) and cavities connected to azimuth and elevation combiners 260.

In an example embodiment, RF antenna 100 comprises a passive integrated condensation control system. The passive condensation control system can be formed integral with any suitable component of RF antenna 100. For example, the passive condensation control system can be formed integral with aperture 210. Moreover, in one example embodiment, the passive condensation control system can be formed integral with aperture horn plate 250. In other example embodiments, not shown, the passive condensation control system can be integral with aperture grid plate 240 or azimuth combiner 260. Regardless of where on antenna 100 the passive condensation control system is integrated, it is noted that the integration of the passive condensation control system can be a significant benefit. Integration of the passive condensation control system can facilitate creating a compact, space efficient, light weight antenna. Integration can facilitate use of no external hardware, no discrete parts, no tubing, and/or no fittings. In stating that this can be implemented without fittings, it is intended that, in an example embodiment, the system can have no tubing interface fittings or similar plumbing type pipe interface fittings. Thus, the integrated passive condensation control system can be configured to provide a light weight and small antenna. This can be very useful for airborne satellite antennas where reduction in antenna mass can reduce aircraft service costs. In addition, a small antenna's swept volume under the aerodynamic fairing radome can facilitate a reduction in radome size and aerodynamic drag which again can reduce aircraft service costs.

Figure 3:
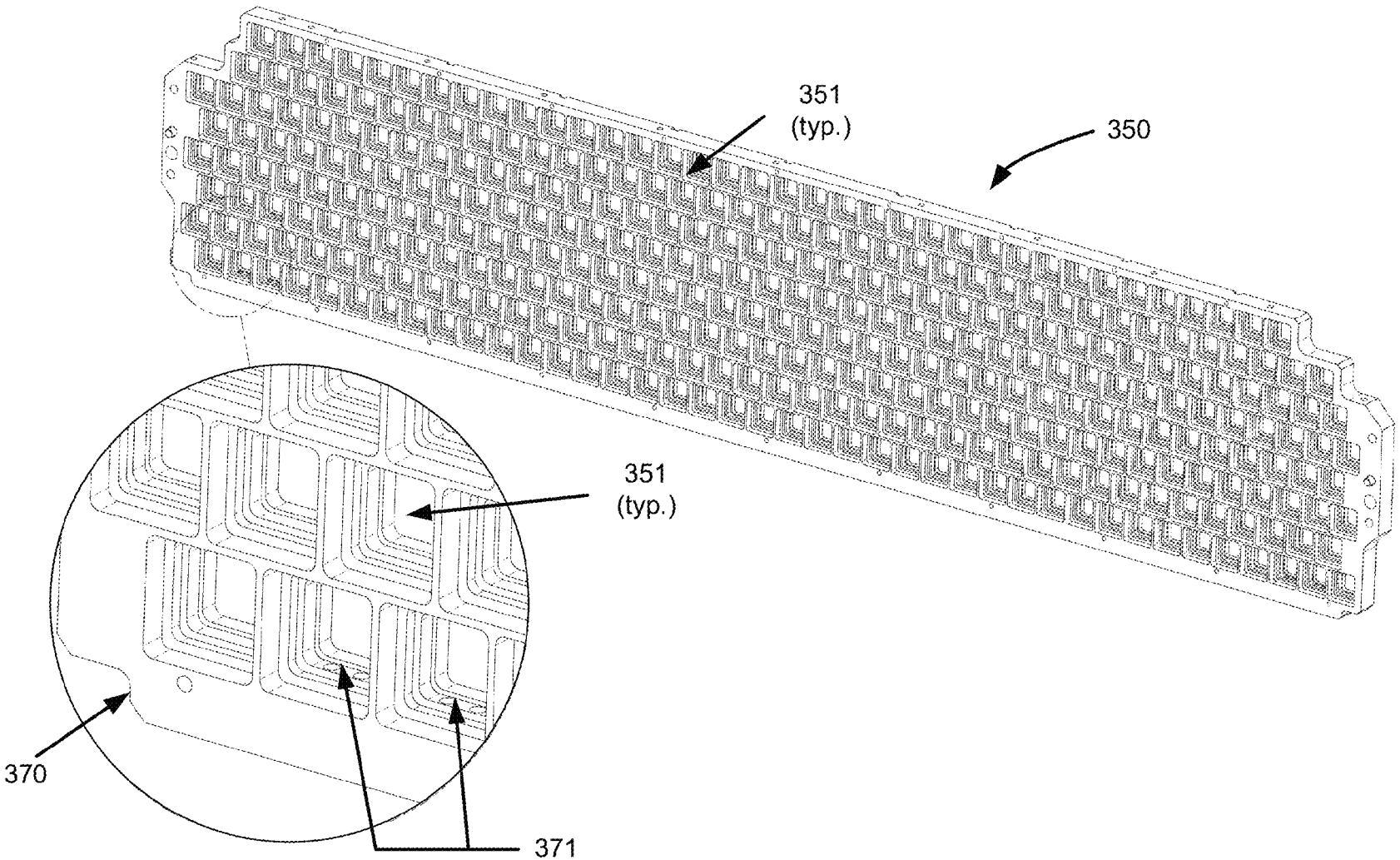
FIG. 3 is a perspective view of an example RE antenna aperture horn plate with an example integrated desiccant channel component, and showing example vent holes therefrom.

With reference now to FIG. 3, aperture horn plate 350 can comprise a passive integrated condensation control system 370. As shown in FIG. 3, aperture horn plate can comprise multiple feed horns 351. Feed horns 351 can be arranged in any suitable array, grid, or pattern. For example, feed horns 351 can be arranged in rows of feed horns. In one example embodiment illustrated in FIG. 3, feed horns 351 can be laid out in 8 rows of feed horns in aperture horn plate 350. Passive integrated condensation control system 370 can be located along one side of aperture horn plate 350. In one example embodiment, passive integrated condensation control system 370 can be located along the long edge of aperture horn plate 350. Moreover, passive integrated condensation control system 370 can be located along more than one edge of aperture horn plate 350. In this example embodiment, the desiccant channel may wrap around at least a portion of the horn plate increasing the length of the desiccant channel. Thus, the passive integrated condensation control system 370 can be integral with the aperture horn plate. Moreover, passive integrated condensation control system 370 can be located in any suitable location integral with aperture horn plate 350. Passive integrated condensation control system 370 can comprise a desiccant airflow channel. Thus, in one example embodiment, aperture horn plate 350 can comprise a desiccant airflow channel that can be integral with the aperture horn plate.

Passive integrated condensation control system 370 can he connected to the internal air volume via vent holes 371. In one embodiment, aperture horn plate 350 can comprise holes providing an air passage way between passive integrated condensation control system 370 and the internal air volume, It should be recognized that by providing vent holes 371 to at least one feed horn 351, because the various feed horns can be interconnected via the waveguide combiners, passive integrated condensation control system 370 can be connected to all of the interconnected feed horns of aperture horn plate 350. In FIG. 3, it can be seen that vent holes 371 can be provided to two feed horns 351. In an example embodiment, vent hole(s) 371 can be connected to the internal air volume at a low current area of the system. For example, compared to various portions of the waveguide combiner structure, the aperture horn plate can be a low current area of structure defining the internal air volume. Moreover, in an example embodiment, where the structure defining the internal air volume can comprise multiple repetitive (similar to each other) parts (e.g., the azimuth combiners), the vent hole(s) can be connected to the internal air volume at a non-repetitive part (e.g., the aperture horn plate). In an example embodiment, the vent hole(s) can be connected to the internal air volume at a portion of the structure that can be common each port of the array.

In an example embodiment vent holes 371 can be round, oval, rectangular, or any suitable shape. In an example embodiment, vent holes 371 can be similar in size to Bethe hole couplers, wherein an individual hole can couple a very small amount of RF energy (typically less than 30 dB). In an example embodiment, a connected feed horn can be connected by a single vent hole 371. In other example embodiments, a feed horn can be connected by two vent holes 371. Moreover, vent holes 371 can be any size, shape, number and dimension sufficient to provide enough air flow between passive integrated condensation control system 370 and the internal air volume to control condensation within the antenna system consistent with the principles described herein.

Figure 4:
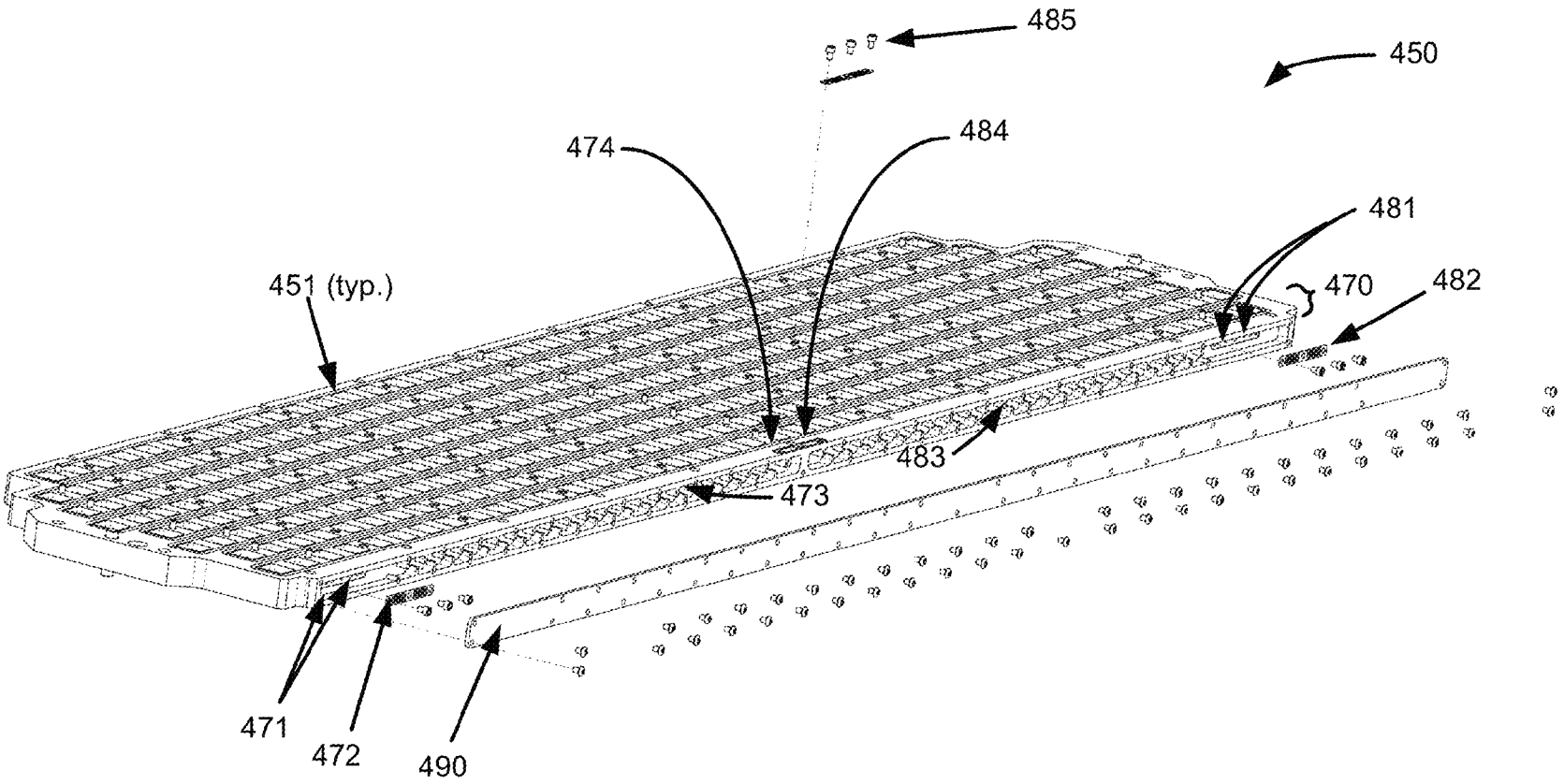
FIG. 4 is an exploded perspective view of an example RF antenna aperture horn plate with an example integrated desiccant channel component, and showing an example interior structure thereof.

With reference now to FIG. 4, an aperture horn plate 450 can comprise feed horns 451 and a passive integrated condensation control system 470. Passive integrated condensation control system 470 can comprise a desiccant air flow channel 473 that can he integral with aperture horn plate 450. Desiccant air flow channel 473 can he configured to vent the internal air volume to the environment outside of the RF antenna device through desiccant airflow channel 473. Although described herein as the "environment outside of the RF antenna," other equivalent terms can be used such as "external environment" or "ambient air."

Passive integrated condensation control system 470 can comprise at least one vent hole opening to at least one feed horn 451. In an example embodiment, a first vent hole 471 can open to a feed horn 451 and a second vent hole 471 can open to a second feed horn 451. Vent holes 471 can be configured to provide an air passage way between the internal air volume and desiccant air flow channel 473. Moreover, desiccant air flow channel 473 can open to the external environment via an exterior port 474. Thus, air can flow from the internal air volume through vent hole 471, through desiccant air flow channel 473, and through exterior port 474. Exterior port 474, similar to vent hole 471, can be of any suitable shape, size, number, and dimension to facilitate sufficient air flow through desiccant air flow channel 473. Stated another way, desiccant air flow channel 473 can comprise: a first port connecting an open space in desiccant airflow channel 473 to the internal air volume; and a second port connecting the open space in desiccant airflow channel 473 to the external environment. In various example embodiments, the first port can be a first air ingress/egress port and the second port can be a second air ingress/egress port. Stated yet another way, desiccant air flow channel 473 can comprise a channel structure having a first end opening to the internal air volume and a second end opening to the environment. Stated another way, desiccant air flow channel 473 comprises an open space facilitating airflow between the internal air volume and the external environment.

In one embodiment, desiccant air flow channel 473 can comprise a serpentine airflow channel. The serpentine airflow channel effectively increases the length of the airflow channel 473 between the vent port 471 and external port 474. The serpentine air flow channel can be configured to increase dwell time of the air passing through the desiccant material in the channel. Thus, the length and course (e.g., serpentine) of the airflow channel can be designed to achieve a desired air/desiccant interaction. Typically, the longer the channel, the better, so in one embodiment, the integrated condensation control system 470 can be integrated on the long edge of the aperture horn plate 450. As mentioned before, in another example embodiment, the channel may be made longer by wrapping it around more than one side of aperture horn plate 450. In another example the desiccant channel can be made longer by wrapping the channel back and adjacent to itself one or more times on a common side.

Desiccant air flow channel 473 can be a chamber or airflow channel that is filled with a desiccant material. The integrated condensation control system therefore can be a packed bed desiccant air flow channel. The desiccant material located in desiccant air flow channel 473 can, in one example embodiment, be aluminum dioxide. Moreover, the desiccant material can be: molecular sieve, silica gel, montmorillonite clay, calcium sulfate, calcium chloride. Furthermore, any suitable desiccant material can be used that dries the air within the internal air volume under the circumstances contemplated herein. For example, that dries the air within the internal air volume while cycling between (1) relatively higher altitude, drier air and (2) relatively lower altitude, moister air. The desiccant material can be selected to optimize air drying for the intended environmental conditions.

In an example embodiment, high altitude may be from 10,000 feet to 40,000 feet. Stated another way, cruising altitude for an airplane bearing the RF antenna may be approximately 35,000 feet. In various example embodiments, cruising altitude can be at a high altitude. At these relatively higher altitudes, the atmospheric pressure may be approximately 20 to 30 kPa. In an example embodiment, low altitude may be from 300 feet below sea level to 5,500 feet above sea level. At these relatively lower altitudes, the atmospheric pressure may be approximately 100 kPa.

In one example embodiment, integrated condensation control system 470 can comprise two desiccant air flow channels. For example, integrated condensation control system 470 can comprise a primary desiccant air flow channel 473 and a redundant desiccant air flow channel 483. In this embodiment, primary desiccant air flow channel 473 can comprise a first primary port 471 and a second primary port 474, and redundant desiccant air flow channel 483 can comprise a first redundant port 481 and a second redundant port 484. The first primary and redundant ports 471/481 can connect the respective desiccant air flow channels 473/483 to the internal air volume. The second primary and redundant ports 474/484 can connect the respective desiccant air flow channels 473/483 to the exterior environment. In the illustrated example embodiment of FIG. 4, the second primary and redundant ports can be located in approximately the center of the long side of aperture horn plate 450 and thus can be located proximate to each other. In this case, in one example embodiment, a filter screen 485 can be configured to cover both the second primary port 474 and second redundant port 484.

In an example embodiment, integrated condensation control system 470 can comprise a first filter screen 472 at first port 471 and a second filter screen at the second port 474. In a primary/redundant embodiment, the first primary port(s) 471 and or first redundant port(s) 481 can be covered with filter screens 472/482, respectively. The first filter screens 472/482 can be configured to be located between desiccant airflow channel 473/483 and the internal air volume. The second filter screen 485 can he configured to be located between desiccant airflow channel and the exterior environment.

In one embodiment, the filter screens can be made of a perforated metal sieve. In other example embodiments, the filter screens can be a microporous expanded PTFE (ePTFE) membrane or similar porous metallic, plastic or glass material. Moreover, the filter screens, internal filter screens 472/482 or external filter screens (e.g., 485), can be any filter screen configured to (1) retain desiccant particles within the desiccant airflow channel, (2) while allowing air to pass through desiccant airflow channel(s) 473/483 between the internal air volume and the external environment, and (3) that will allow sufficient pressure equalization (reducing differential pressure gradients between ambient environment and internal hardware air cavity).

For example, a microporous of membrane prevents pressure build up by constantly equalizing the difference in pressure between the inside of the enclosure and its immediate environment. This can reduce the pressure on the seals. The filter can be configured to allow air and other gases to pass through the membrane freely but stop liquids from entering the enclosure. It is noted that even small air pressure differentials can have an detrimental impact on large surface area components such as the aperture close-out 230. Thus, filter screens can be selected to have low airflow resistance so as to not induce a large pressure differential.

In an example embodiment, integrated condensation control system 470 comprises a cover plate 490. Cover plate 490 can be located proximate to the desiccant air flow channel and between the desiccant air flow channel and the exterior environment. Cover plate 490 can be made of aluminum or any suitable non-porous material. Cover plate 490 can be generally flat and sized to cover the channel and vent ports. Furthermore, cover plate 490 can be any size, shape or material suitable for retaining the desiccant material within desiccant air flow channel 473/483. Cover plate 490 can be attached using any suitable fastener, to aperture horn plate 450. In one example embodiment, cover plate 490 can be removable for replacing the desiccant. In another example embodiment, cover plate 490 comprises some or all of the desiccant channel when attached to aperture horn plate 450.

Figure 5:
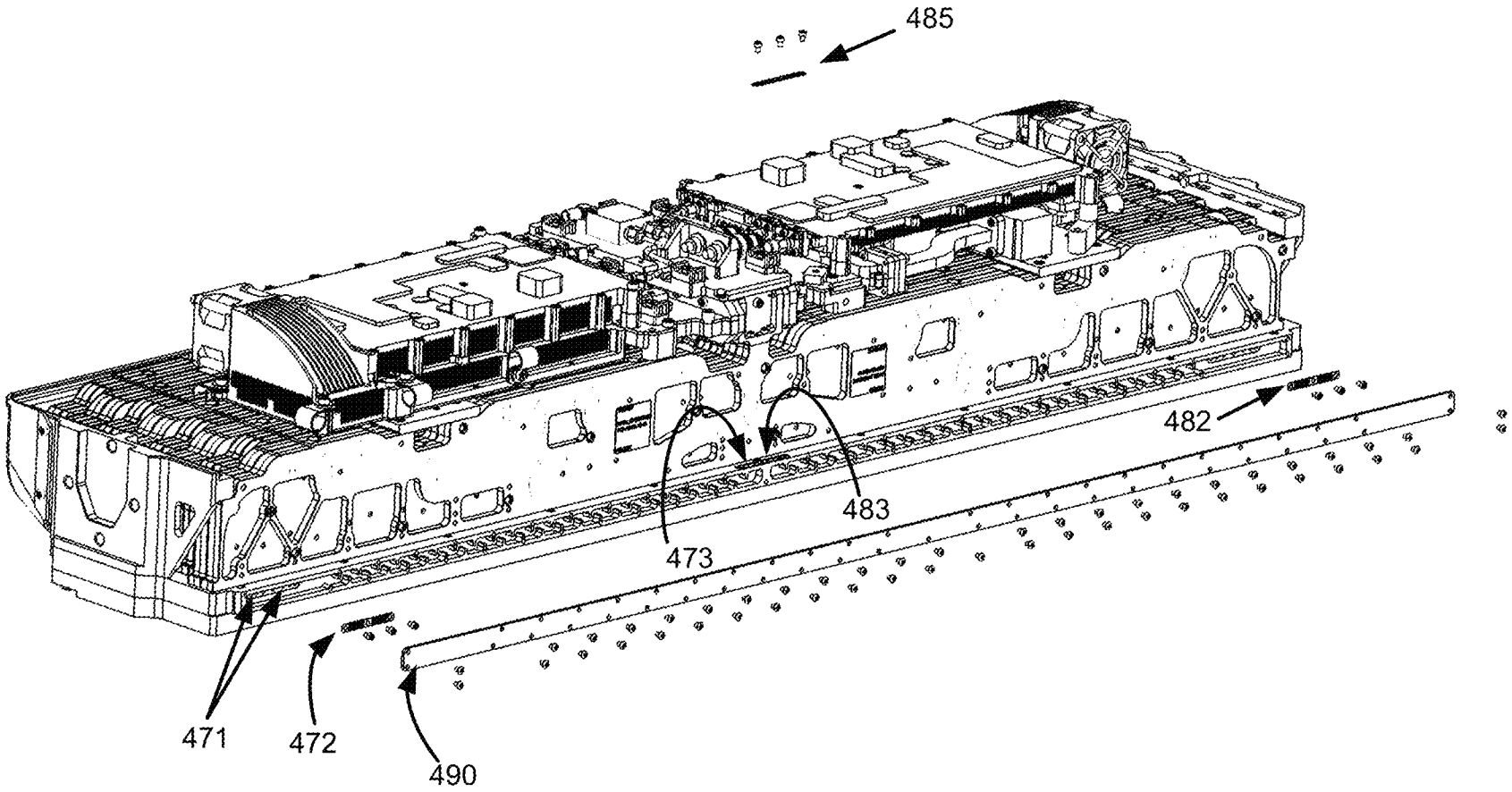
FIG. 5 is another exploded perspective view of an example REP antenna with an example integrated desiccant channel component.
Figure 6:
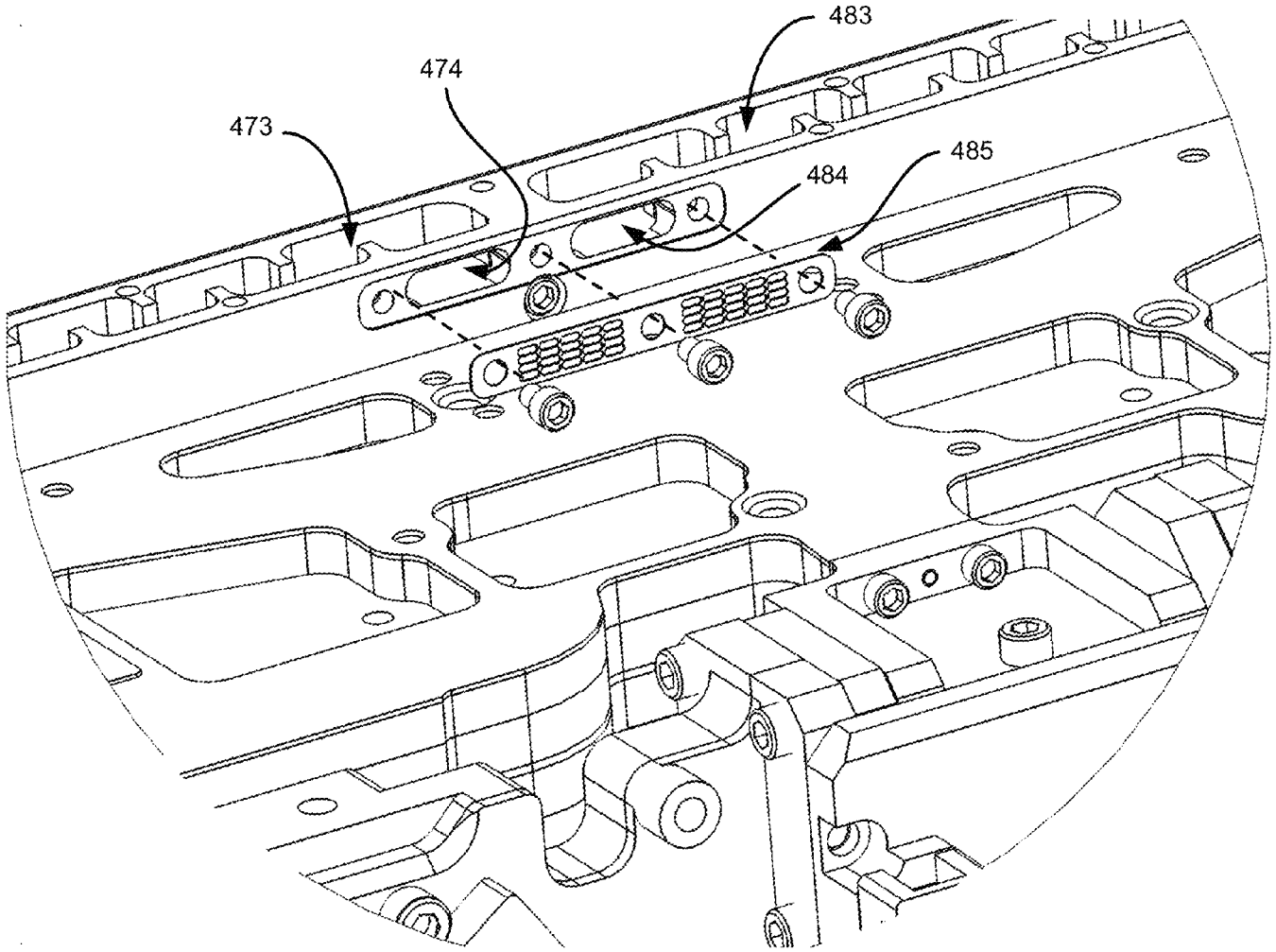
FIG. 6 is an exploded perspective view of a filter screen portion of an example integrated desiccant channel component.
Figure 7:
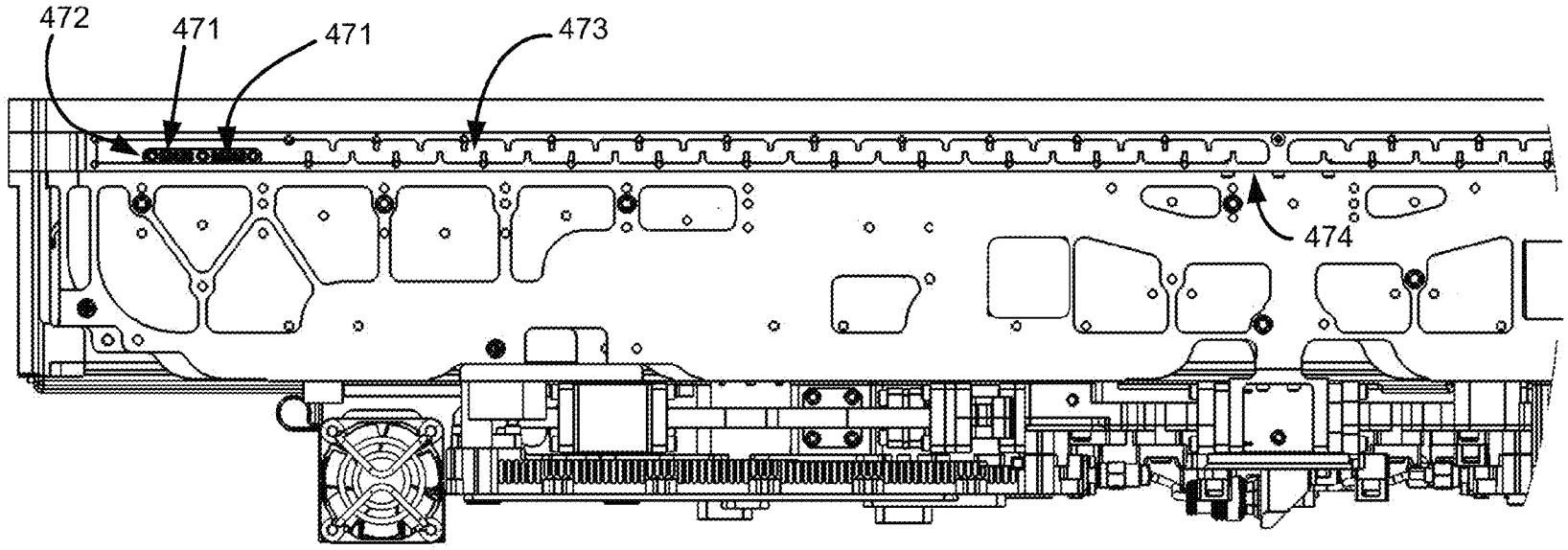
FIG. 7 is an end view of a portion of an example integrated desiccant chamber.
Figure 8:
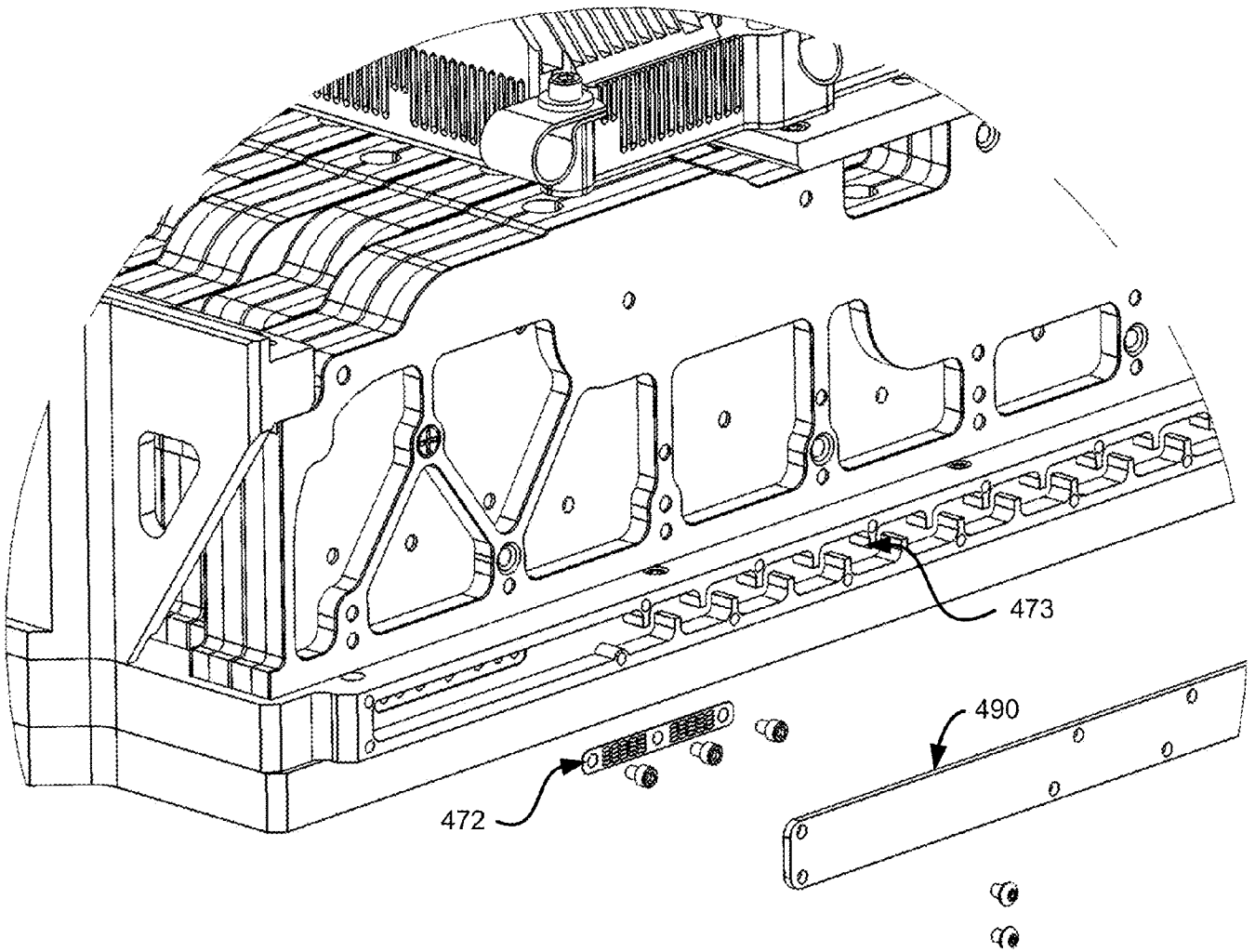
FIG. 8 is an exploded perspective view of a filter screen portion of an example integrated desiccant channel component.
Figure 9:
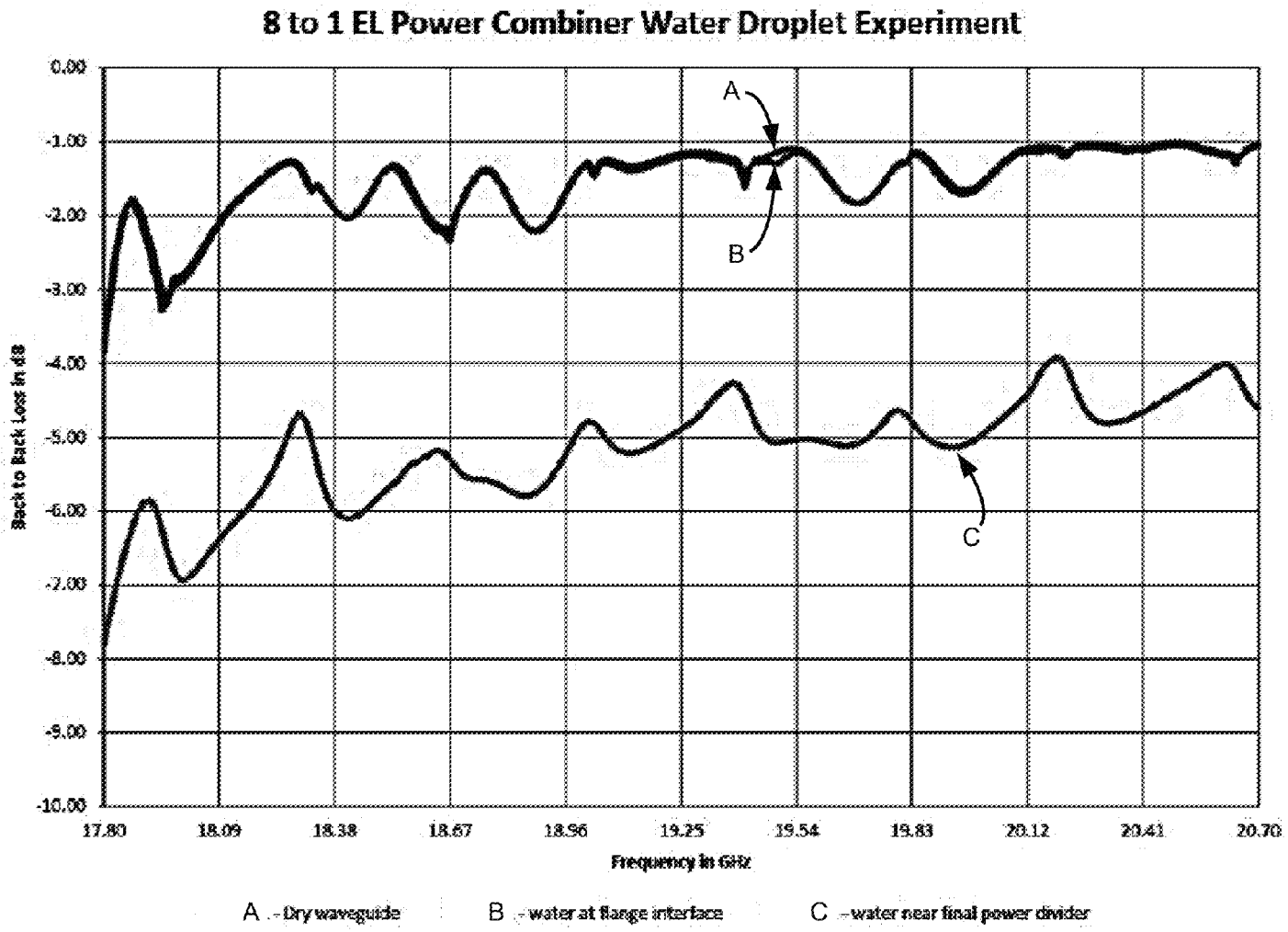
FIG. 9 is a graph illustrating the impact of a droplet of moisture located in each port of an RF combiner.

With momentary reference to FIGS. 5-8, 11 and 12, an example antenna is illustrated in FIG. 5 showing the location of the passive integrated condensation control system 470 in the overall assembly, with components already discussed identified by similar reference numbers.

In accordance with various aspects, an example method of protecting a vented internal air volume of an RF antenna using integrated passive condensation control, including an integrated desiccant air flow channel filled with desiccant, comprises absorbing moisture from relatively moist air flowing into the internal air volume while the RF antenna descends through low altitude regions, absorbing moisture that might otherwise reach the internal air volume while the RF antenna remains at ground level, and regenerating the desiccant while the RF antenna descends through high altitude regions. The method further comprising regenerating the desiccant while cruising at a relatively high altitude.

Figure 10:
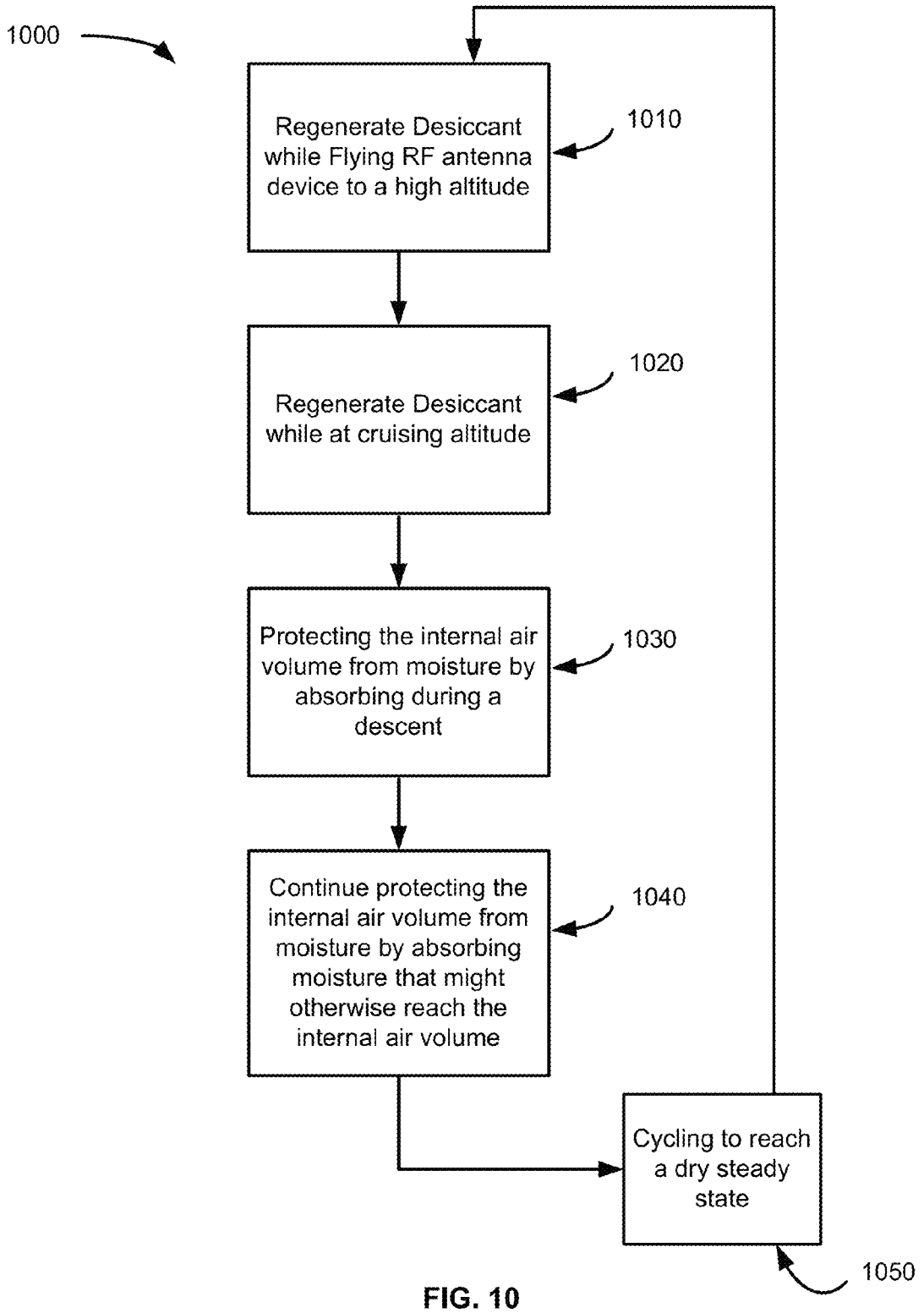
FIG. 10 is a flow chart for an example method disclosed herein.
Figure 11:
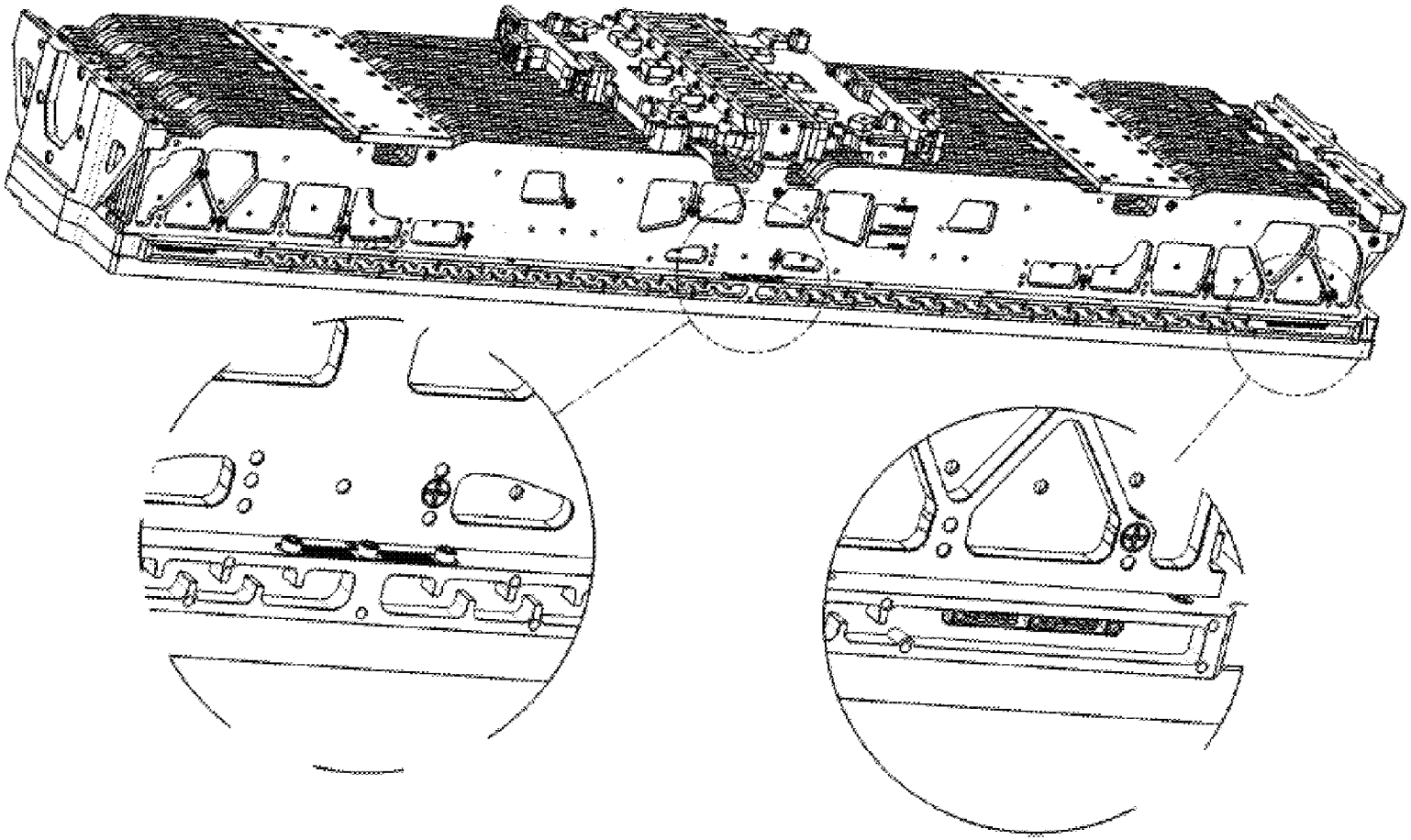
FIGS. 11-12 are perspective views of a filter screen portion of an example integrated desiccant channel component.
Figure 12:
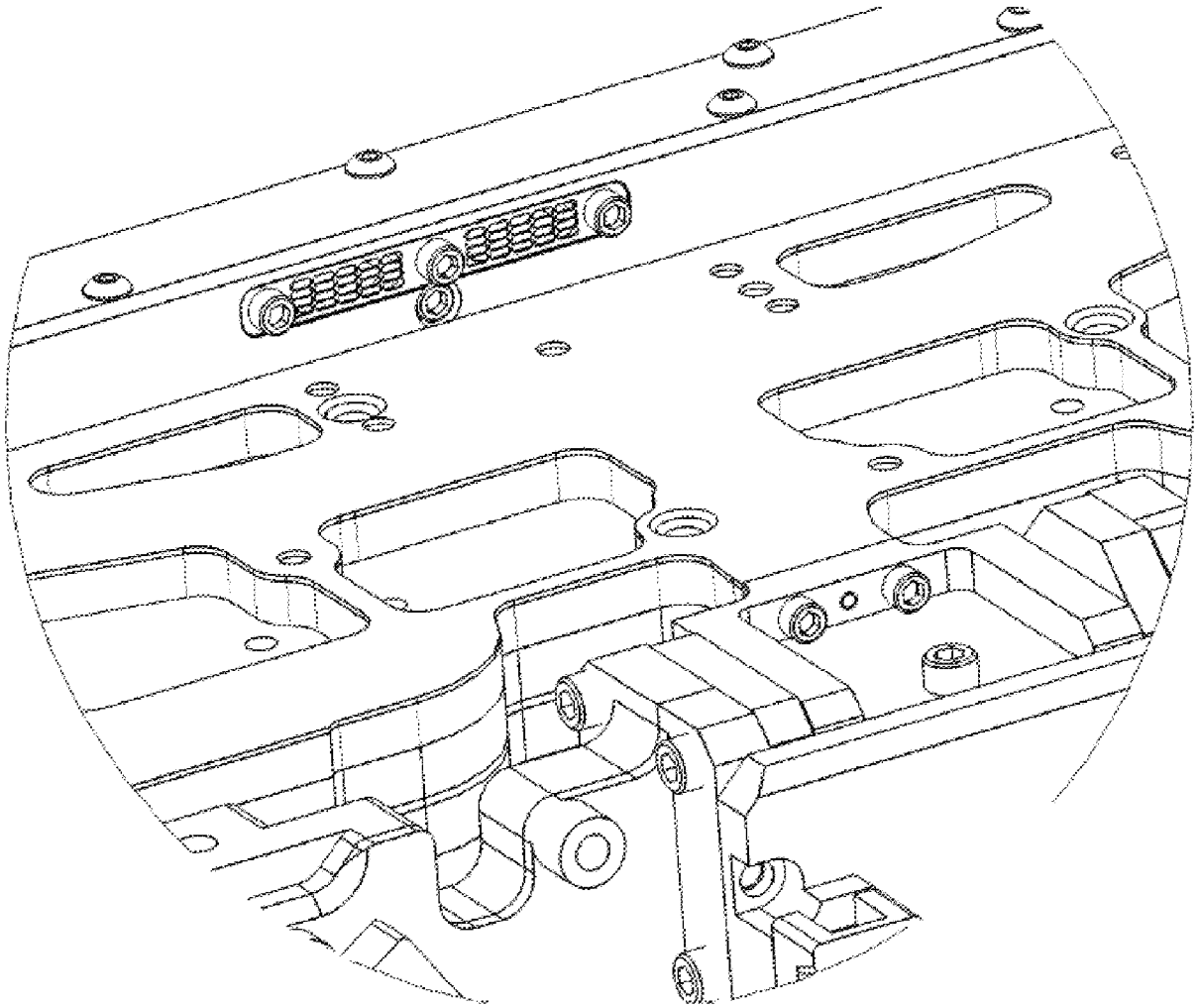

In accordance with various aspects, and with reference to FIG. 10, a description of use of the integrated passive condensation control system is described in the context of an airborne RF antenna. A method 1000 for providing passive condensation control, in an airborne RF antenna device having an internal air volume vented to atmosphere, can comprise the operation of regenerating a desiccant in the integrated passive condensation control system by flying the airborne RF antenna device to a high altitude (operation 1010). The high altitude can mean an altitude higher than 10,000 feet above sea level, or to an altitude where the air is drier than the humidity level within the desiccant. Thus, in one embodiment, this operation can comprise movement of the device to a dry air environment having relatively lower atmospheric pressure than the starting point. In accordance with an example embodiment, the integrated passive condensation control system can be configured to maintain the relative humidity in the internal air volume below the dew point.

During the ascent and descent phases of the flight, atmospheric pressure decreases and increases, and the air in the internal air volume can expand and contract. In other words, the decrease and increase in altitude can cause a pressure differential between the inner air volume and the exterior environment that causes a net flow of air in and out of the internal air volume, by way of the desiccant air flow channel. The air at high altitude regions can be relatively dry. As this dry air flows through the desiccant, the absorbed moisture in the desiccant can be released to the dry air, facilitating the regeneration of the desiccant.

The method can further comprise regenerating the desiccant while cruising at relatively higher altitude (operation 1020). In this phase, the desiccant may continue to exchange moisture away from the desiccant and into the relatively dry air of the exterior environment.

The method can further comprise protecting the internal air volume from moisture by absorbing moisture during a descent in altitude (operation 1030). During a descent, the ambient air pressure can increase causing air inside the internal air volume to contract and generate an air flow from the external environment into the internal air volume. The desiccant can absorb moisture in the infiltrating air, protecting the internal air volume. Moreover, while stationed at a relatively lower altitude with relatively warmer and moister air, the desiccant can continue absorbing moisture to protect the internal air volume (operation 1040).

It is noted that to implement this method, one merely has to move/cycle (operation 1050) the RF antenna from a moist low altitude environment to a dry high altitude environment. Although the relative humidity of the internal air volume can fluctuate during each cycle, even if initially very humid, the internal air volume can reach a "steady state" where the relative humidity can be low. This can be done with no external hardware, no discrete components, no power to operate fans or pumps or heaters, no fittings, and no tubing.

This can be useful because the antenna can be protected even if it is turned off/powered off. In contrast, a pump, valve, or heater implemented solution may not protect the internal air volume from moisture if powered off/out of service. The antenna can even be protected for a period of time if it is left on a shelf or parked on the ground (until the desiccant saturates). The passive regenerative air dryer solution can be low maintenance and has no moving parts. In an example embodiment, a "passive" device can be a device that has no electrical external power source (e.g., battery or generator). This can be done while also minimizing pressure differentials between the ambient environment and the air cavity within the hardware structure.

The waveguide combiner/dividers that can define part of the internal air volume can be comprised of H-plane T-junction type waveguide combiners/dividers. In one example embodiment, the H-plane T-junction waveguide combiner comprises an offset asymmetric septum and in another example embodiment, the H-plane T-junction waveguide combiner comprises an E-plane septum as discussed in more detail in a co-filed patent application, U.S. application Ser. No. 13/707,049, entitled "in-Phase H-Plane Waveguide T-Junction With E-Plane Septum," filed Dec. 6, 2012, and incorporated herein by reference.

RF antenna systems, related power distribution networks, and methods of making the same can be further described in U.S. patent application Ser. No. 13/707,160, entitled "Dual-Circular Polarized Antenna System," and filed Dec. 6, 2012 on the same date as this application, which is incorporated herein by reference in its entirety.

In describing the present invention, the following terminology will be used: The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

It should be appreciated that the particular implementations shown and described herein are illustrative of the invention and its best mode and are not intended to otherwise limit the scope of the present invention in any way. Furthermore, the connecting lines shown in the various figures contained herein are intended to represent exemplary functional relationships and/or physical couplings between the various elements. It should be noted that many alternative or additional functional relationships or physical connections may be present in a practical device.

As one skilled in the art will appreciate, the mechanism of the present invention may be suitably configured in any of several ways. It should be understood that the mechanism described herein with reference to the figures is but one exemplary embodiment of the invention and is not intended to limit the scope of the invention as described above.

It should be understood, however, that the detailed description and specific examples, while indicating exemplary embodiments of the present invention, are given for purposes of illustration only and not of limitation. Many changes and modifications within the scope of the instant invention may be made without departing from the spirit thereof, and the invention includes all such modifications. The corresponding structures, materials, acts, and equivalents of all elements in the claims below are intended to include any structure, material, or acts for performing the functions in combination with other claimed elements as specifically claimed. The scope of the invention should be determined by the appended claims and their legal equivalents, rather than by the examples given above. For example, the operations recited in any method claims may be executed in any order and are not limited to the order presented in the claims. Moreover, no element is essential to the practice of the invention unless specifically described herein as "critical" or "essential."

What is claimed is:

1. An antenna device comprising:

at least one antenna element;

a plurality of waveguides coupled to the at least one antenna element, the plurality of waveguides including an internal air volume to propagate RF signals communicated with the at least one antenna element; and a passive condensation control system including a desiccant airflow channel, wherein the desiccant airflow channel is integral with the antenna device and routes airflow between the internal air volume of the plurality of waveguides and an environment external to the antenna device, whereby the passive condensation control system deters condensation of moisture within the internal air volume of the plurality of waveguides.

2. The antenna device of claim 1, wherein the desiccant airflow channel is within an assembly that includes at least one of the at least one antenna element and the plurality of waveguides.

3. The antenna device of claim 1, wherein the desiccant airflow channel includes a regenerative type desiccant.

4. The antenna device of claim 1, wherein the airflow through the desiccant airflow channel is due to a pressure difference between the internal air volume and the environment external to the antenna device.

5. The antenna device of claim 1, wherein the at least one antenna element includes a second internal air volume to further propagate the RF signals, the second internal air volume directly connected to the internal air volume of the plurality of waveguides.

6. The antenna device of claim 1, wherein the internal air volume of the plurality of waveguides is non-hermetically sealed.

7. The antenna device of claim 1, wherein the passive condensation control system maintains relative humidity in the internal air volume below the dew point while the desiccant airflow channel is not saturated.

8. The antenna device of claim 1, wherein the passive condensation control system includes at least one vent hole to couple the desiccant airflow channel to the internal air volume.

9. The antenna device of claim 8, wherein coupling of RF energy from the internal air volume into the at least one vent hole is less than 30 dB.

10. The antenna device of claim 1, wherein the desiccant airflow channel deters the condensation of moisture within the internal air volume when the antenna device is powered off.

11. The antenna device of claim 1, wherein the passive condensation control system contains no electrical external power source.

12. The antenna device of claim 1, wherein the passive condensation control system further includes a second desiccant airflow channel between the internal air volume of the plurality of waveguides and the environment external to the antenna device.

13. The antenna device of claim 1, wherein the desiccant airflow channel includes a serpentine shaped segment.

14. The antenna device of claim 1, further comprising an array of antenna elements, the array of antenna elements including the at least one antenna element, wherein the plurality of waveguides are coupled to the array of antenna elements.

15. An antenna device comprising:

at least one antenna element;

a plurality of waveguides coupled to the at least one antenna element, the plurality of waveguides including an internal air volume to propagate RF signals communicated with the at least one antenna element; and passive condensation means for deterring condensation of moisture within the internal air volume of the plurality of waveguides, and for venting the internal air volume of the plurality of waveguides to an environment external to the antenna device, wherein the passive condensation means is integral with the antenna device.

16. The antenna device of claim 15, wherein the passive condensation means is within an assembly that includes at least one of the at least one antenna element and the plurality of waveguides.

17. The antenna device of claim 15, wherein the passive condensation means includes a regenerative type desiccant through which the internal air volume is vented.

18. The antenna device of claim 15, wherein the passive condensation means includes no electrical external power source.

19. The antenna device of claim 15, further comprising an array of antenna elements, the array of antenna elements including the at least one antenna element, wherein plurality of waveguides are coupled to the array of antenna elements.

* * * * *